US009644458B2

(12) United States Patent
Vu

(10) Patent No.: US 9,644,458 B2
(45) Date of Patent: May 9, 2017

(54) SCREEN COMMUNICATION SLEEVE ASSEMBLY AND METHOD

(71) Applicant: Phong Vu, Houston, TX (US)

(72) Inventor: Phong Vu, Houston, TX (US)

(73) Assignee: Delta Screen & Filtration, LLC, Houston, TX (US)

( * ) Notice: Subject to any disclaimer, the term of this patent is extended or adjusted under 35 U.S.C. 154(b) by 214 days.

(21) Appl. No.: 14/510,215

(22) Filed: Oct. 9, 2014

(65) Prior Publication Data

US 2015/0101804 A1 Apr. 16, 2015

Related U.S. Application Data

(60) Provisional application No. 61/889,281, filed on Oct. 10, 2013.

(51) Int. Cl.
*E21B 43/08* (2006.01)
*E21B 17/043* (2006.01)

(52) U.S. Cl.
CPC ..... *E21B 43/088* (2013.01); *E21B 17/043* (2013.01)

(58) Field of Classification Search
CPC ..... E21B 43/088; E21B 43/10; E21B 43/08; E21B 17/04; E21B 17/18; E21B 17/043
See application file for complete search history.

(56) References Cited

U.S. PATENT DOCUMENTS 4,510,996 A 4/1985 Hardin
4,842,063 A * 6/1989 Coetzee ..... E21D 20/02 166/285
5,476,143 A * 12/1995 Sparlin ..... E21B 43/088 166/233
5,515,915 A 5/1996 Jones et al.
5,865,251 A 2/1999 Rebardi et al.
5,868,200 A 2/1999 Bryant et al.
6,405,800 B1 6/2002 Walker et al.
6,409,219 B1 6/2002 Broome et al.
(Continued)

FOREIGN PATENT DOCUMENTS

EP 0622523 A2 11/1994

OTHER PUBLICATIONS

Merriam-Webster, Abut, Accessed Aug. 17, 2016, http://www.merriam-webster.com/dictionary/abut.*
(Continued)

*Primary Examiner* — Jennifer H Gay
*Assistant Examiner* — David Carroll
(74) *Attorney, Agent, or Firm* — Keeling Law, LLC; Kenneth A. Keeling; Mark S. Solomon

(57) ABSTRACT

Fluid flow between screen-pipe annuli of pipe sections in a down-hole well structure is provided by a fluid communication sleeve assembly that may be installed where adjacent pipe sections are connected. A flow ring is provided at each pipe section end, each flow ring providing fluid communication from and to an annulus between a screen and a corresponding base pipe. The fluid communication sleeve assembly includes a screen shield spaced from the adjoining pipes and the pipe joint, the screen shield connected to a flow ring at each screen shield end, and a lock nut at each screen shield end, the lock nut retaining a screen shield end to a corresponding flow ring. A method for providing fluid flow between screen-pipe annuli of pipe is also provided.

14 Claims, 6 Drawing Sheets

(56) References Cited

U.S. PATENT DOCUMENTS

| | | | | |
|---|---|---|---|---|
| 6,978,840 | B2 * | 12/2005 | Henderson | E21B 34/14 166/296 |
| 7,048,061 | B2 | 5/2006 | Bode et al. | |
| 7,690,097 | B1 | 4/2010 | Cooper et al. | |
| 8,245,778 | B2 * | 8/2012 | Yeh | E21B 43/082 166/236 |
| 9,010,417 | B2 * | 4/2015 | Garcia | E21B 43/04 166/205 |
| 2002/0038707 | A1 | 4/2002 | Gillespie et al. | |
| 2002/0189808 | A1 * | 12/2002 | Nguyen | E21B 43/045 166/278 |
| 2003/0183386 | A1 * | 10/2003 | McGregor | E21B 17/042 166/278 |
| 2004/0140089 | A1 * | 7/2004 | Gunneroed | E21B 34/06 166/228 |
| 2008/0169099 | A1 * | 7/2008 | Pensgaard | E21B 33/138 166/285 |
| 2010/0270789 | A1 | 10/2010 | Surveyor et al. | |
| 2011/0253391 | A1 | 10/2011 | Veit et al. | |
| 2012/0048536 | A1 * | 3/2012 | Holderman | B23P 11/025 166/228 |
| 2013/0000890 | A1 | 1/2013 | Olenick et al. | |
| 2013/0206394 | A1 | 8/2013 | Garcia et al. | |
| 2014/0008081 | A1 * | 1/2014 | O'Brien | E21B 19/16 166/380 |

OTHER PUBLICATIONS

International Search Report, Jan. 9, 2015.
ISA Written Opinion, Jan. 9, 2015.

* cited by examiner

SCREEN COMMUNICATION SLEEVE ASSEMBLY AND METHOD

CROSS-REFERENCE TO RELATED APPLICATIONS

This application claims the benefit of U.S. Provisional Application No. 61/889,281 filed on Oct. 10, 2013, which application is incorporated herein by reference as if reproduced in full below.

STATEMENT REGARDING FEDERALLY SPONSORED RESEARCH OR DEVELOPMENT

Not applicable.

FIELD OF THE INVENTION

The present invention relates generally to systems and methods of controlling fluid flow in a well bore. More specifically, the present invention addresses fluid communication between adjacent pipe sections in a well wherein the screens are provided exterior of the pipe sections, the screens defining annuli between the pipe and the screens. The present invention addresses fluid communication between annuli of adjacent screen-containing pipe sections.

BACKGROUND

Down-hole drilling operations commonly require filter screens to restrain flow of sand and particulates existing in the well environment from entering pipe openings. In a common application, filter screens are provided exterior of a base pipe, creating an annular opening between the screen and the pipe interior of the filtering screen (referred to herein as a screen-pipe annulus). In such applications, it is often desirable to provide fluid communication between pipe-screen annuli of adjacent pipe sections.

Fluid communication between adjacent screen-pipe annuli facilitates gravel packing operations by providing a flow path between adjacent gravel pack zones. See, for example, U.S. Pat. No. 4,510,996 to Hardin. Fluid communication between adjacent annuli allows slurry fluids in the annuli of adjacent pipe sections to flow to a port provided in one or more of multiple pipe sections. See, for example, U.S. Pat. No. 6,405,800 to Walker, et al.

Exemplary prior art fluid communication devices to control flow between annular sections of adjacent pipe are described in U.S. Pat. No. 4,510,996 to Hardin, U.S. Pat. No. 6,405,800 to Walker, et al., U.S. Pat. No. 5,868,200 to Bryant, et al., and U.S. Pat. No. 5,865,251 to Rebardi, et al.

BRIEF SUMMARY OF THE INVENTION

Fluid flow between screen-pipe annuli of pipe sections in a down-hole well structure is provided by a fluid communication sleeve assembly that may be installed at adjacent pipe sections, a flow ring provided at each pipe section end, each flow ring providing fluid communication from and to an annulus between a screen and a corresponding base pipe. The fluid communication sleeve assembly includes a screen shield spaced from the adjoining pipes and the pipe joint, the screen shield connected to a flow ring at each screen shield end, and a lock nut at each screen shield end, the lock nut retaining a screen shield end to a corresponding flow ring.

BRIEF DESCRIPTION OF THE DRAWINGS

For a more complete understanding of the exemplary embodiments, reference is now made to the following Description of Exemplary Embodiments of the Invention, taken in conjunction with the accompanying drawings, in which.

DESCRIPTION OF EXEMPLARY EMBODIMENTS OF THE INVENTION

Figure 1:
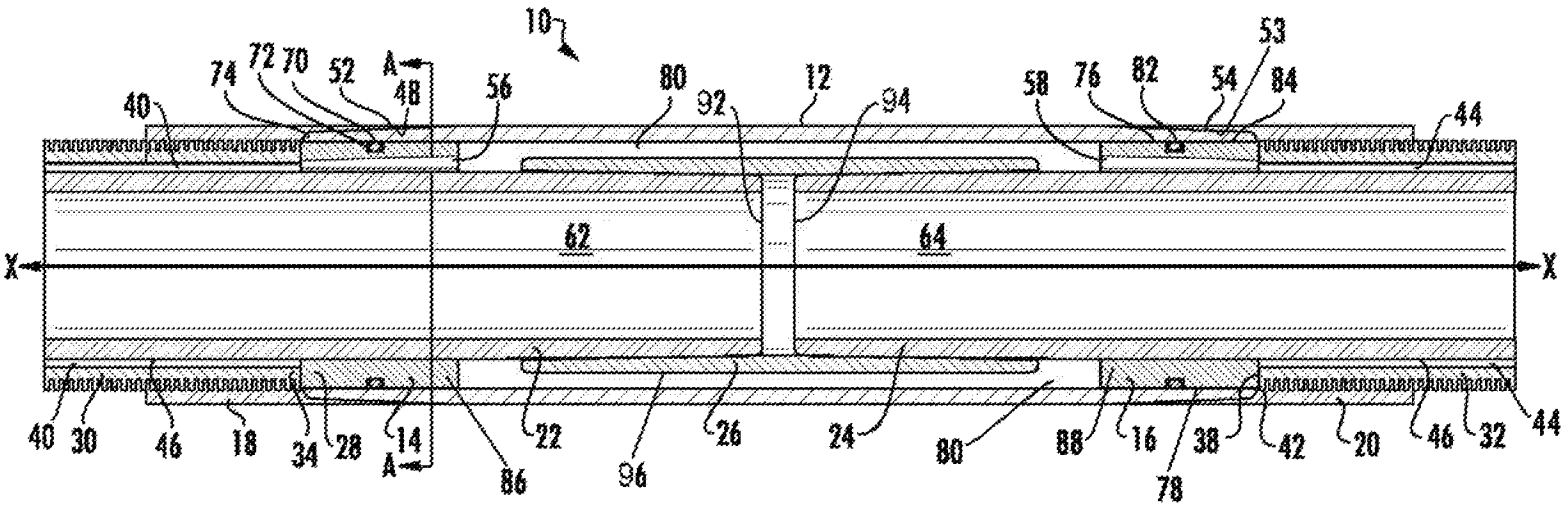
FIG. 1 depicts a longitudinal cross section of an embodiment of a fluid communication sleeve assembly.

The exemplary embodiments are best understood by referring to the drawings, with like numerals being used for like and corresponding parts of the various drawings. As used herein, longitudinal refers to the axis X-X identified in Figure and transverse refers to a direction normal to axis X-X of FIG. 1.

Referring to FIG. 1, a cross-sectional view of a fluid communication sleeve assembly 10 is depicted. Fluid communication sleeve assembly 10 includes a screen shield 12, a flow ring 14, a flow ring 16, a lock nut 18, and a lock nut 20.

Figure 2:
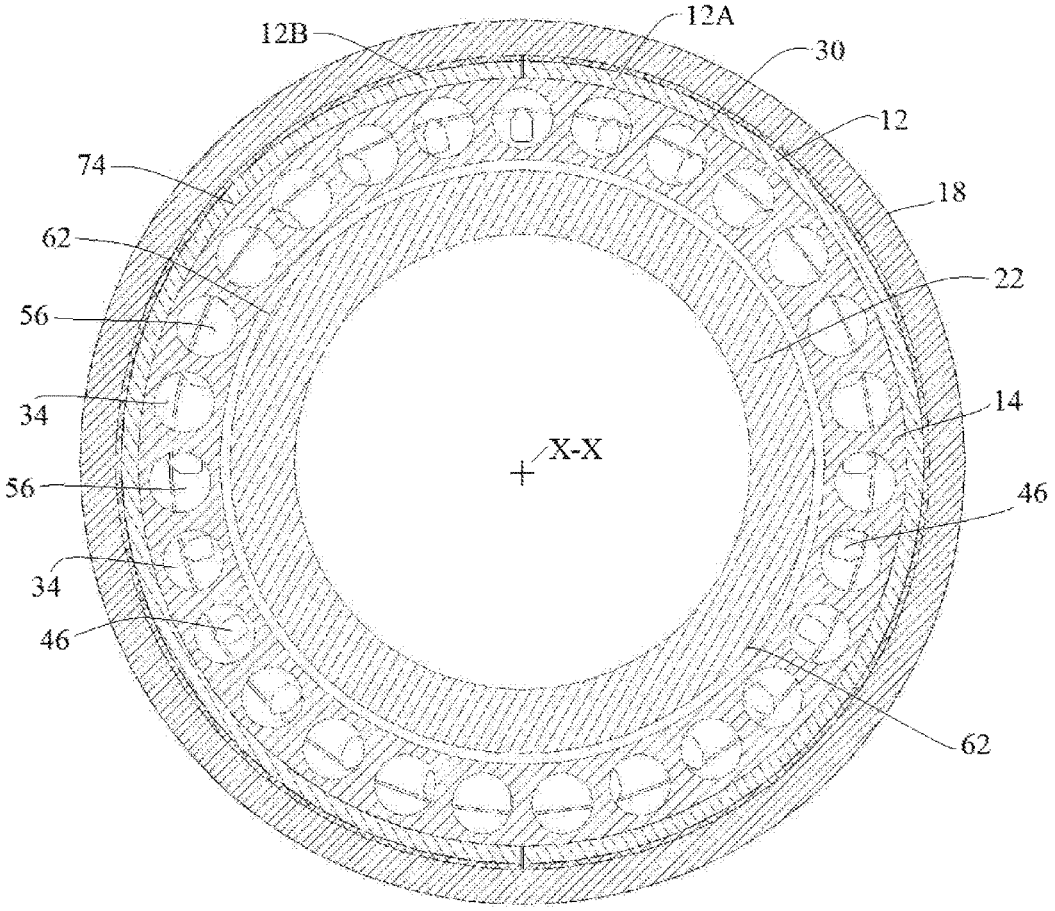
FIG. 2 depicts a transverse cross section of the fluid communication sleeve assembly at A-A of FIG. 1.
Figure 3:
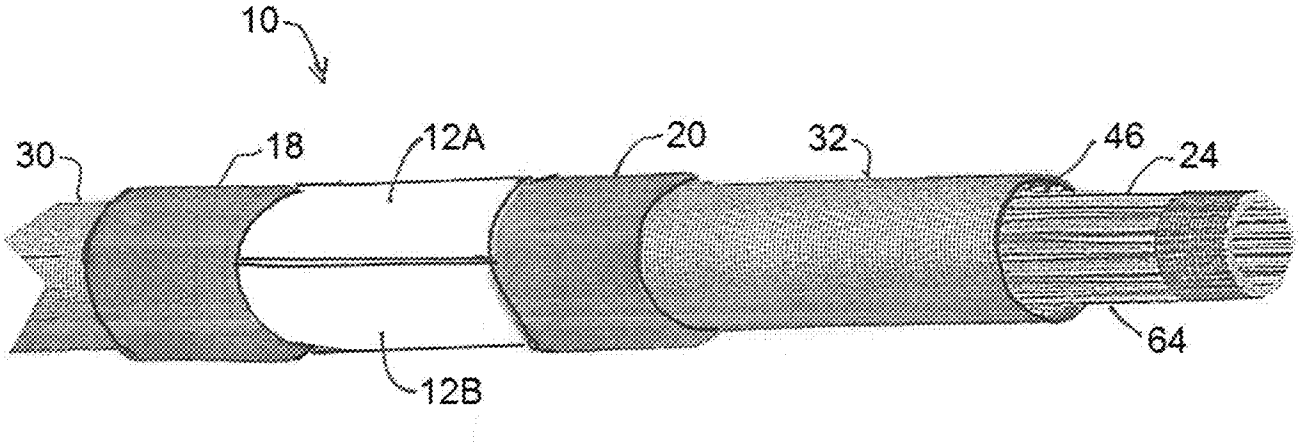
FIG. 3 depicts an exterior view of the fluid communication sleeve assembly.

Sleeve assembly 10 is depicted in FIGS. 1, 2, and 3 as installed at a pipe joint (not labeled) of pipe 22 with pipe 24. In the embodiment depicted, pipes 22 and 24 are connected in accordance with industry practice by connector 26.

A screen 30 is concentrically arranged with pipe 22 and spaced from pipe 22 defining an annulus 40 between screen 30 and pipe 22. In like manner, a screen 32 is concentrically arranged with pipe 24 and spaced from pipe 24 defining an annulus 44 between screen 32 and pipe 24.

In an exemplary embodiment, each of screen 30 and screen 32 is a wire wrap screen comprising wire concentrically wrapped around pluralities of longitudinally-extending ribs 46. End views of ribs 46 are depicted in FIG. 2. Ribs 46 are spaced circumferentially around the interior of screens 30 and 32. Ribs 46 are accordingly intermediate screen 30 and pipe 22. Separate ribs 46 are intermediate screen 32 and pipe 24.

Flow ring 14 is fixedly connected at ring end 28 thereof to screen end 34 of screen 30. Flow ring 14 is further fixedly attached to exterior surface 62 of pipe 22. In like manner ring end 38 of flow ring 16 is connected to screen end 42 of screen 32. Flow ring 16 is further fixedly attached to exterior surface 64 of pipe 24. In an exemplary embodiment, attachment of flow ring 14 to screen end 34 and to pipe 22 is by welding and attachment of flow ring 16 to screen end 42 and to pipe 24 is by welding.

Figure 5:
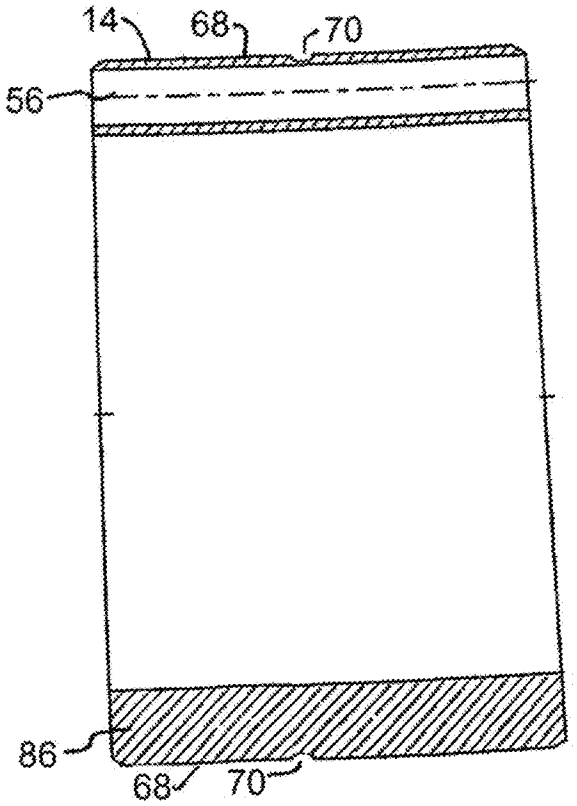
FIG. 5 depicts a cross-section of a flow ring at B-B of FIG. 4.
Figure 4:
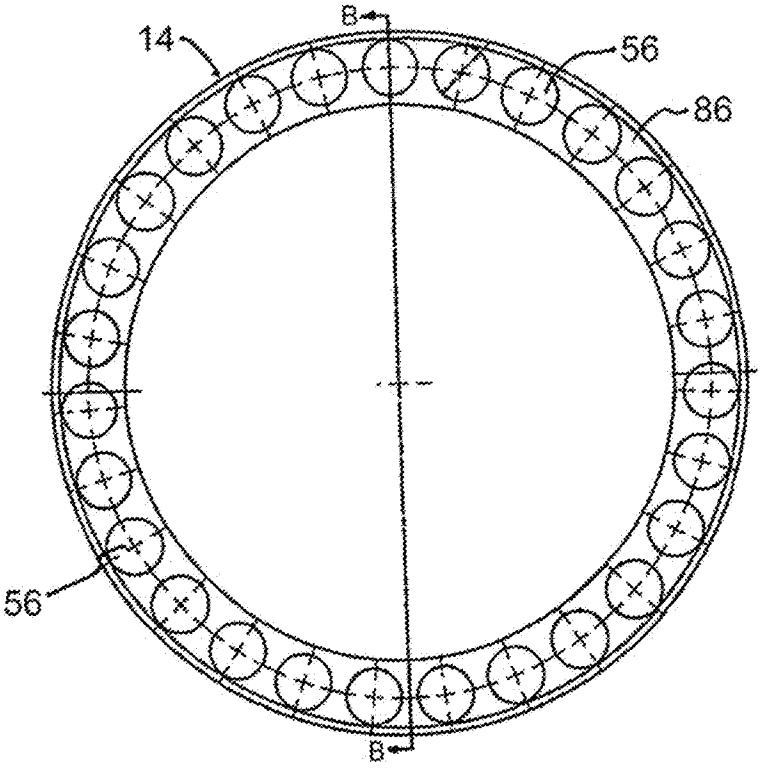
FIG. 4 depicts an end view of a flow ring.

Referring to FIG. 4, an end view of flow ring 14 is depicted. Referring to FIG. 5, a cross-sectional view of flow ring 14 at B-B of FIG. 4 is depicted. Flow ring 14 comprises a cylindrical structure defined by ring body 86. A plurality of flow openings 56 extend longitudinally through ring body 86 of flow ring 14. Referring again to FIGS. 1 and 2, flow ring 14 is sized and structured in relation to screen 30 and the exterior surface 62 of pipe 22 such that flow openings 56 are aligned with pipe-screen annulus 40 to allow fluid communication between annulus 40 and flow openings 56. In like manner, flow ring 16 comprises a cylindrical structure defined by a ring body 88. A plurality of flow openings 58 extend longitudinally through ring body 88 of flow ring 16. Flow ring 16 is sized and structured in relation to screen 32 and the exterior surface 64 of pipe 24 such that flow openings 58 are aligned with pipe-screen annulus 44 to allow fluid communication between annulus 44 and flow openings 58.

Figure 6:
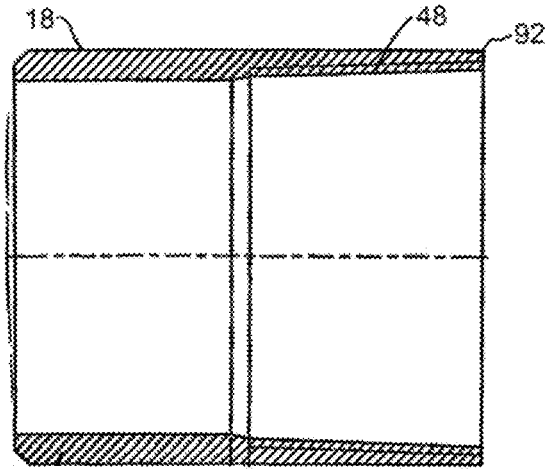
FIG. 6 depicts a cross-section of a lock nut.
Figure 7:
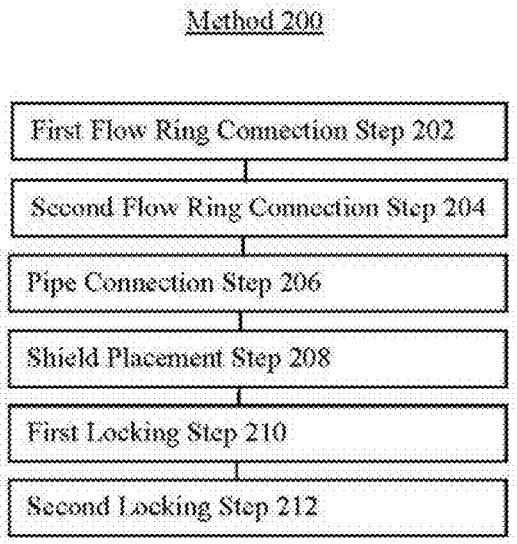
FIG. 7 depicts a method of the present invention.

Referring to FIG. 6, a cross-sectional view of lock nut 18 is depicted. Lock nut 18 is provided with an interior threaded section 48 for attachment to an exterior threaded section 52 of screen shield 12. Lock nut 18 is sized and structured to extend exterior of screen shield 12 and flow ring 14. Referring to FIG. 1, lock nut 18 is depicted attached to threaded section 52 of screen shield 12. Lock nut 18 fixedly engages screen shield 12 to flow ring 14. Lock nut 18 further extends exterior of a portion of screen 30.

Referring to FIG. 2, a cross-sectional view of sleeve assembly 10 at section A-A of FIG. 1 depicts lock nut 18, flow ring 14, screen shield 12, and pipe 22 in an attached arrangement. Pipe 22, flow ring 14, screen shield 12, and lock nut 18 are concentrically arranged in relation to axis X-X with pipe 22 interior of flow ring 14, flow ring 14 interior of screen shield 12, and screen shield 12 interior of lock nut 18. In the embodiment depicted, screen shield 12 is constructed of two segments identified as segment 12A and segment 12B. Segments 12A and 12B, when joined, comprise a cylindrical screen shield 12.

Still referring to FIG. 2, end views of multiple flow openings 56 are depicted. Portions of end 34 of screen 30 are visible through flow openings 56. Ends of ribs 46 are also visible through flow openings 56.

Referring to FIG. 1, lock nut 20 is shown attached to flow ring 16, screen shield 12, and pipe 24, in like manner as is shown attachment of lock nut 18, flow ring 14, screen shield 12, and pipe 22.

In an exemplary embodiment, screen shield 12 may be constructed from a single elongated tube cut axially along a diameter thereof to provide two semi-circular screen shield sections 12A and 12B.

Referring again to FIG. 5, a seal ring opening 70 is provided in exterior surface 68 of flow ring 14. Seal ring opening 70 receives ring seal 72 (shown in FIG. 1). Ring seal 72 provides sealing engagement of flow ring 14 with an interior surface 74 of sleeve 12 proximate threaded section 52. In like manner, a seal ring opening 76 is provided in exterior surface 78 of flow ring 16. A ring seal 82 provides sealing engagement of flow ring 16 with an interior surface 84 of sleeve 12 proximate threaded section 54.

Referring to FIG. 3 it may be seen that, upon attachment, shield 12, comprising segments 12A and 12B, is fixedly positioned intermediate lock nut 18 and lock nut 20. Segments 12A and 12B abut to provide a substantially continuous shield around the pipe joint (not visible in FIG. 3).

Referring again to FIG. 1, annulus 80 is depicted. Annulus 80 is defined by the interior surface of shield 12, connector 26 exterior surface 96, pipe 22 exterior surface 62, and pipe 24 exterior surface 64. Annulus 80 extends longitudinally from flow ring 14 to flow ring 16. Accordingly, annulus 80 provides fluid communication from flow ring 14 to flow ring 16. As flow ring 14 exterior surface 68 sealingly engages interior surface 74 of sleeve 12 proximate threaded section 52, and flow ring 16 exterior surface 78 sealingly engages interior surface 84 of sleeve 12 proximate threaded section 54, annulus 80 allows fluid flow between flow ring 14 and flow ring 16.

Still referring to FIG. 1, fluid communication is provided from annulus 40 to and from annulus 44 by way of flow ring 14, annulus 80, and flow ring 16.

The exemplary sleeve assembly of the present invention may be readily installed at a pipe joint. A pipe 22 having a screen 30 and a flow ring 14 as described herein is provided. A lock nut 18 is positioned concentrically with and exterior of screen 30 with its interior threaded section 48 oriented toward pipe 22 pipe end 92. A lock nut 20 is positioned concentrically with and exterior of screen 32 with its interior threaded section 53 oriented toward pipe 24 pipe end 94. Pipe 22 and pipe 24 are connected at the pipe joint (not labeled). In the exemplary embodiment, such connection is made at connecter 26 in accordance with industry practice for the pipe to be joined.

Shield sections 12A and 12B are concentrically arranged exterior of flow rings 14 and 16 in a manner such that shield sections 12A and 12B establish a continuous shield 12. Ring seal 72 is positioned intermediate shield 12 and lock ring 14. Ring seal 82 is positioned intermediate shield 12 and lock ring 16. Lock nut 18 interior threaded section 48 is attached to exterior threaded section 52 of screen shield 12. Lock nut 20 interior threaded section 53 is attached to exterior threaded section 54 of screen shield 12. Upon completion of installation, annulus 80 is formed as depicted in FIG. 1.

Method

A method 200 of providing fluid communication between a first pipe-screen annulus of a first pipe having a first external screen and a second pipe-screen annulus of a second pipe having a second external screen, comprising:

A first flow ring connecting step 202 of connecting a first flow ring to the first pipe external screen and pipe, the first flow ring allowing flow there through to and from the first pipe-screen annulus.

A second flow ring connecting step 204 of connecting a second flow ring to the second pipe external screen and pipe, the second flow ring allowing flow there through to and from the second pipe-screen annulus.

A pipe connection step 206 of connecting the first pipe and the second pipe.

A shield placement step 208 of providing a shield extending exterior of a segment of the first flow ring, a segment of the second flow ring, an end of the first pipe, and an end of the second pipe, to define a sleeve annulus intermediate the shield and the first pipe end and second pipe end.

A first locking step 210 of attaching an end of the shield to the first flow ring.

A second locking step 212 of attaching the other end of the shield to the second flow ring.

In an exemplary embodiment, pipe connection step 206 further comprises placing a first threaded locking nut on the first pipe external screen and a second threaded locking nut on the second pipe external screen prior to connecting the first pipe to the second pipe, shield placement step 208 comprises providing two connecting shield segments, first locking step 210 comprises threadably attaching the first locking nut to the first flow ring, and second locking step 212 comprises threadably attaching the second locking nut to the second flow ring.

While the preferred embodiments of the invention have been described and illustrated, modifications thereof can be made by one skilled in the art without departing from the teachings of the invention. Descriptions of embodiments are exemplary and not limiting. The extent and scope of the invention is set forth in the appended claims and is intended to extend to equivalents thereof. The claims are incorporated into the specification. Disclosures of existing patents, publications and known art are incorporated herein to the extent required to provide reference details and understanding of the disclosure herein set forth.

I claim:

1. A fluid communication sleeve assembly comprising:

a screen shield adapted to be fixedly attached to a first pipe which contains a first exterior screen, and a second pipe which contains a second exterior screen, wherein:

the first exterior screen is disposed in a position relative to the first pipe that provides a first annulus between an interior surface of the first exterior screen and an exterior surface of the first pipe;

the second exterior screen is disposed in a position relative to the second pipe that provides a second annulus between an interior surface of the second exterior screen and an exterior surface of the second pipe;

an end of the first pipe and an end of the second pipe are joined; and fixed attachment of the screen shield to the first pipe and the second pipe provides a sleeve annulus which provides fluid communication between the first annulus and the second annulus; wherein:

the first annulus, the second annulus, and the sleeve annulus are not in fluid communication with the interior of said pipes within the fluid communication sleeve assembly; and the first annulus, the second annulus, and the sleeve annulus are in fluid communication with the exterior of said exterior screens only via said exterior screens.

2. The apparatus of claim 1, wherein the first screen, the second screen, or both the first screen and the second screen, comprises wire concentrically wrapped around a plurality of longitudinally extending ribs.

3. The apparatus of claim 1, wherein the screen shield comprises a plurality of proximately positioned screen shield segments.

4. The apparatus of claim 1, wherein providing the fluid communication between the first annulus and the second annulus comprises utilizing two or more flow rings, each flow ring comprising one or more flow openings, wherein at least one flow ring is fixedly attached to an end of the first pipe and an end of the first exterior screen, and at least one flow ring is fixedly attached to an end of the second pipe and an end of the second exterior screen.

5. The apparatus of claim 4, wherein at least one of the flow rings fixedly attached to an end of the first pipe and an end of the first exterior screen is attached by welding, and at least one of the flow rings fixedly attached to an end of the second pipe and an end of the second exterior screen is attached by welding.

6. The apparatus of claim 4, wherein the screen shield is attached with a lock nut to at least one flow ring fixedly attached to an end of the first pipe and an end of the first exterior screen, and the screen shield is attached with a lock nut to at least one flow ring fixedly attached to an end of the second pipe and an end of the second exterior screen.

7. A fluid communication sleeve assembly comprising:

a screen shield adapted to be fixedly attached to a first pipe which contains a first exterior screen, and a second pipe which contains a second exterior screen, wherein:

the first exterior screen is disposed in a position relative to the first pipe that provides a first annulus between an interior surface of the first exterior screen and an exterior surface of the first pipe;

the second exterior screen is disposed in a position relative to the second pipe that provides a second annulus between an interior surface of the second exterior screen and an exterior surface of the second pipe;

an end of the first pipe and an end of the second pipe are joined; and at least one first flow ring comprising one or more flow openings is fixedly attached to an end of the first pipe and an end of the first exterior screen;

at least one second flow ring comprising one or more flow openings is fixedly attached to an end of the second pipe and an end of the second exterior screen;

the screen shield is attached to the first flow ring and the second flow ring with a lock nut; and fixed attachment of the screen shield to the first pipe and the second pipe provides a sleeve annulus which provides fluid communication between the first annulus and the second annulus; wherein:

the first annulus, the second annulus, and the sleeve annulus are not in fluid communication with the interior of said pipes within the fluid communication sleeve assembly; and the first annulus, the second annulus, and the sleeve annulus are in fluid communication with the exterior of said exterior screens only via said exterior screens.

8. The apparatus of claim 7, wherein the first screen, the second screen, or both the first screen and the second screen, comprises wire concentrically wrapped around a plurality of longitudinally extending ribs.

9. The apparatus of claim 7, wherein the screen shield comprises a plurality of proximately positioned screen shield segments.

10. The apparatus of claim 7, wherein at least one of the flow rings fixedly attached to an end of the first pipe and an end of the first exterior screen is attached by welding, and at least one of the flow rings fixedly attached to an end of the second pipe and an end of the second exterior screen is attached by welding.

11. A method for providing fluid communication sleeve assembly comprising:

a first pipe-screen annulus of a first pipe having a first exterior screen and a second pipe screen annulus of a second pipe having a second exterior screen, comprising:

a first flow ring connecting step of connecting a first flow ring to the first pipe external screen and pipe, the first flow ring allowing flow there through to and from the first pipe screen annulus;

a second flow ring connecting step of connecting a second flow ring to the second pipe external screen and pipe, the second flow ring allowing flow there through to and from the second pipe screen annulus;

a pipe connection step of connecting the first pipe and the second pipe;

a shield placement step of providing a shield extending exterior of an end of the first pipe, and an end of the second pipe, to define a sleeve annulus intermediate the shield and the first pipe end and second pipe end;

a first locking step of attaching an end of the shield to the sleeve and pipe; and a second locking step of attaching the other end of the shield to the sleeve and pipe wherein:

the first exterior screen is disposed in a position relative to the first pipe that provides the first pipe-screen annulus between an interior surface of the first exterior screen and an exterior surface of the first pipe, and the second exterior screen is disposed in a position relative to the second pipe that provides the second pipe-screen annulus between an interior surface of the second exterior screen and an exterior surface of the second pipe; and fluid communication is provided between the first pipe-screen annulus and the second pipe-screen annulus by the sleeve annulus; wherein:

the first annulus, the second annulus, and the sleeve annulus are not in fluid communication with the interior of said pipes within the fluid communication sleeve assembly; and the first annulus, the second annulus, and the sleeve annulus are in fluid communication with the exterior of said exterior screens only via said exterior screens.

12. The method of claim 11, wherein the shield provided in the shield placement step comprises a plurality of shield segments.

13. The method of claim 11, wherein connecting the first pipe and the second pipe in the pipe connection step comprises placing a first threaded locking nut on the first pipe exterior screen and a second threaded locking nut on the second pipe exterior screen prior to connecting the first pipe to the second pipe.

14. The method of claim 13, wherein attaching an end of the shield to the first flow ring in the first locking step comprises threadably attaching the first locking nut to the first flow ring, and attaching the other end of the shield to the second flow ring in the second locking step comprises threadably attaching the second locking nut to the second flow ring.

* * * * *